US010819029B2

(12) United States Patent
Amiri et al.

(10) Patent No.: US 10,819,029 B2
(45) Date of Patent: Oct. 27, 2020

(54) ELECTRONIC DEVICE HAVING MULTI-FREQUENCY ULTRA-WIDEBAND ANTENNAS

(71) Applicant: Apple Inc., Cupertino, CA (US)

(72) Inventors: Mikal Askarian Amiri, Tempe, AZ (US); Carlo di Nallo, Belmont, CA (US); David Garrido Lopez, Campbell, CA (US); Harish Rajagopalan, San Jose, CA (US); Nikolaj P. Kammersgaard, København (DK); Rodney A. Gomez Angulo, Santa Clara, CA (US); Umar Azad, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 51 days.

(21) Appl. No.: 16/271,617

(22) Filed: Feb. 8, 2019

(65) Prior Publication Data

US 2020/0259258 A1 Aug. 13, 2020

(51) Int. Cl.
*H01Q 5/25* (2015.01)
*H01Q 1/24* (2006.01)
*H01Q 9/16* (2006.01)

(52) U.S. Cl.
CPC ..... *H01Q 5/25* (2015.01); *H01Q 1/24* (2013.01); *H01Q 9/16* (2013.01)

(58) Field of Classification Search
CPC ..... H01Q 5/25; H01Q 9/16; H01Q 1/24
See application file for complete search history.

(56) References Cited

U.S. PATENT DOCUMENTS

| | | | | |
|---|---|---|---|---|
| 7,880,684 | B2 | 2/2011 | Schantz | |
| 9,105,966 | B1 * | 8/2015 | Dou | H01Q 1/243 |
| 9,368,869 | B2 | 6/2016 | Chen et al. | |
| 9,673,511 | B2 | 6/2017 | Lee et al. | |
| 9,768,506 | B2 | 9/2017 | Krogerus | |
| 10,135,149 | B2 | 11/2018 | Zhou | |
| 2008/0198075 | A1 * | 8/2008 | Yoshioka | H01Q 9/40 343/700 MS |
| 2009/0007185 | A1 | 1/2009 | Nix et al. | |

(Continued)

FOREIGN PATENT DOCUMENTS

WO 2011076582 A1 6/2011

*Primary Examiner* — Raymond R Chai
(74) *Attorney, Agent, or Firm* — Treyz Law Group, P.C.; Michael H. Lyons; Tianyi He

(57) ABSTRACT

An electronic device may be provided with control circuitry and doublets of first and second antennas that are used to determine the position and orientation of the device relative to external wireless equipment. The control circuitry may determine the relative position and orientation of the external equipment by measuring the angle of arrival of radio-frequency signals from the external equipment. Each doublet may include first and second cavity-backed slot antennas. The first and second antennas may each include a first slot element that is directly fed and a second slot element that is parasitically fed by the first slot element. The first slot element may radiate in an ultra-wideband communications band at 8.0 GHz and the second slot element may radiate in an ultra-wideband communications band at 6.5 GHz. The doublet may be aligned with a dielectric window in a conductive sidewall for the device.

20 Claims, 11 Drawing Sheets

(56) References Cited

U.S. PATENT DOCUMENTS

| | | | | |
|---|---|---|---|---|
| 2009/0256767 | A1* | 10/2009 | Kan | H01Q 5/25 343/795 |
| 2014/0078008 | A1* | 3/2014 | Kang | H01Q 7/00 343/702 |
| 2015/0116159 | A1* | 4/2015 | Chen | H04B 7/024 343/702 |
| 2016/0190690 | A1 | 6/2016 | Badran et al. | |
| 2017/0040670 | A1 | 2/2017 | Chen et al. | |
| 2017/0077603 | A1* | 3/2017 | Krogerus | H01Q 5/10 |
| 2018/0301819 | A1 | 10/2018 | Kirino et al. | |
| 2020/0161747 | A1* | 5/2020 | Kang | H01Q 1/38 |

* cited by examiner

ELECTRONIC DEVICE HAVING MULTI-FREQUENCY ULTRA-WIDEBAND ANTENNAS

BACKGROUND

This relates to electronic devices and, more particularly, to electronic devices with wireless communications circuitry.

Electronic devices often include wireless communications circuitry. For example, cellular telephones, computers, and other devices often contain antennas and wireless transceivers for supporting wireless communications. Some electronic devices perform location detection operations to detect the location of an external device based on an angle of arrival of signals received from the external device (using multiple antennas).

To satisfy consumer demand for small form factor wireless devices, manufacturers are continually striving to implement wireless communications circuitry such as antenna components for performing location detection operations using compact structures. At the same time, there is a desire for wireless devices to cover a growing number of frequency bands.

Because antennas have the potential to interfere with each other and with components in a wireless device, care must be taken when incorporating antennas into an electronic device. Moreover, care must be taken to ensure that the antennas and wireless circuitry in a device are able to exhibit satisfactory performance over the desired range of operating frequencies.

It would therefore be desirable to be able to provide improved wireless communications circuitry for wireless electronic devices.

SUMMARY

An electronic device may be provided with wireless circuitry and control circuitry. The wireless circuitry may include doublets of first and second antennas that are used to determine the position and orientation of the electronic device relative to external wireless equipment. The control circuitry may determine the position and orientation of the electronic device relative to the external wireless equipment at least in part by measuring the angle of arrival of radio-frequency signals from the external wireless equipment. The radio-frequency signals may be received in at least first and second ultra-wideband communications bands.

Each doublet may include first and second slot antennas formed from a conductive structure such as conductive traces on a dielectric substrate. Each of the first and second slot antennas may include a first slot element that is directly fed by an antenna feed coupled across the first slot element. The first slot element may radiate in the first ultra-wideband communications band (e.g., an 8.0 GHz band). Each of the first and second slot antennas may include a second slot element that is indirectly fed. The first slot element may indirectly feed the second slot element by parasitically exciting the second slot element to radiate in the second ultra-wideband communications band (e.g., a 6.5 GHz band). A tuning capacitor may be coupled across the second slot element.

The device may have a housing with a conductive rear wall and peripheral conductive housing structures that run around a periphery of the device. Conductive tape may ground the conductive traces on the dielectric substrate to the conductive rear wall. The doublet may be aligned with a dielectric antenna window in the peripheral conductive housing structures. The doublet may receive the radio-frequency signals in the first and second ultra-wideband communications bands through the dielectric antenna window. The conductive traces and the conductive tape may form an antenna cavity for the doublet that shields the doublet from electromagnetic interference and that optimizes the radiation pattern of the doublet.

DETAILED DESCRIPTION

Figure 1:
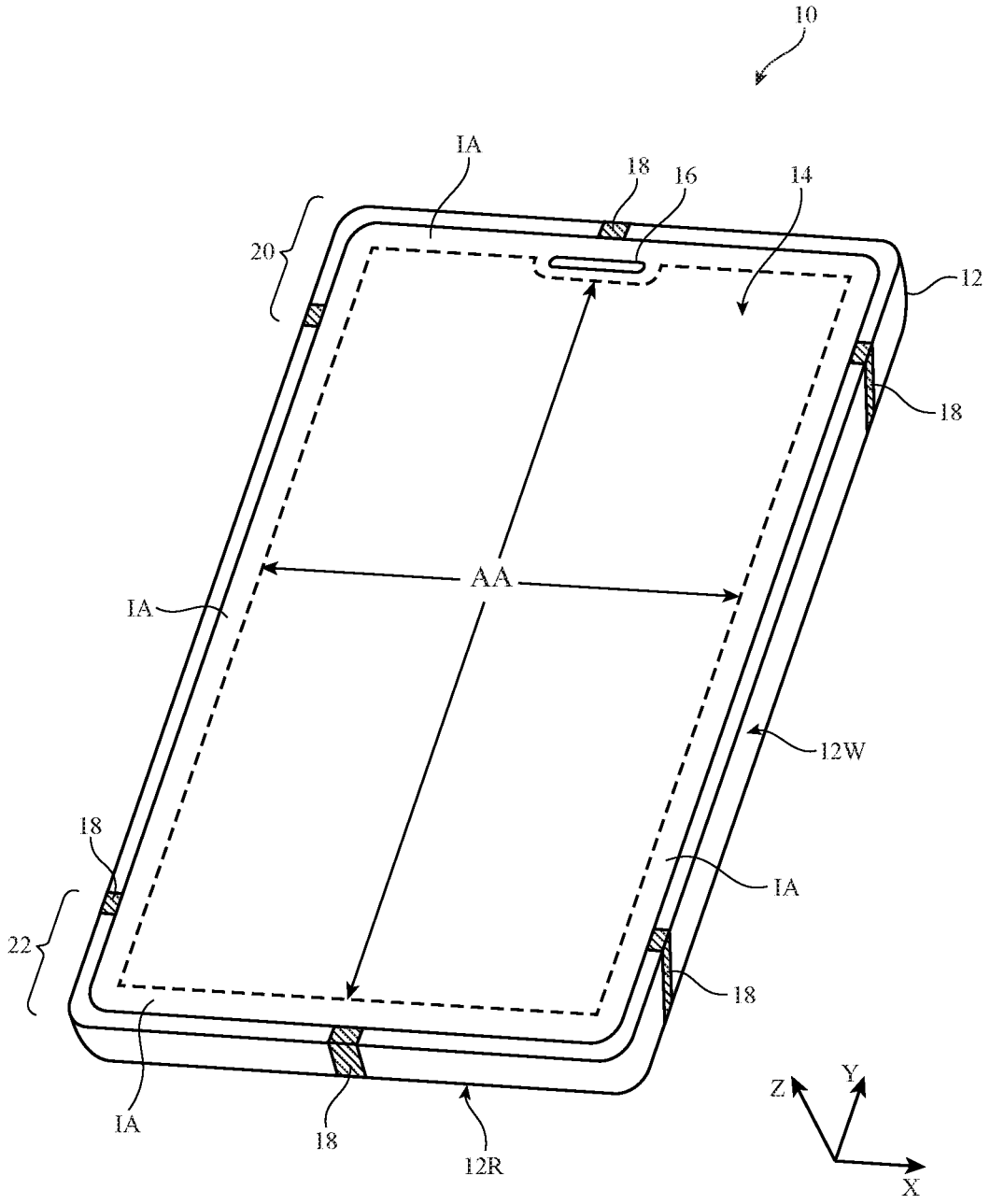
FIG. 1 is a perspective view of an illustrative electronic device in accordance with some embodiments.

Electronic devices such as electronic device 10 of FIG. 1 may be provided with wireless communications circuitry. The wireless communications circuitry may be used to support wireless communications in multiple wireless communications bands. Communications bands (sometimes referred to herein as frequency bands) handled by the wireless communications circuitry can include satellite navigation system communications bands, cellular telephone communications bands, wireless local area network communications bands, near-field communications bands, ultra-wideband communications bands, or other wireless communications bands.

The wireless communications circuitry may include one or more antennas. The antennas of the wireless communications circuitry can include loop antennas, inverted-F antennas, strip antennas, planar inverted-F antennas, slot antennas, hybrid antennas that include antenna structures of more than one type, or other suitable antennas. Conductive structures for the antennas may, if desired, be formed from conductive electronic device structures.

The conductive electronic device structures may include conductive housing structures. The conductive housing structures may include peripheral structures such as peripheral conductive structures that run around the periphery of the electronic device. The peripheral conductive structures may serve as a bezel for a planar structure such as a display, may serve as sidewall structures for a device housing, may have portions that extend upwards from an integral planar rear housing (e.g., to form vertical planar sidewalls or curved sidewalls), and/or may form other housing structures.

Gaps may be formed in the peripheral conductive structures that divide the peripheral conductive structures into peripheral segments. One or more of the segments may be used in forming one or more antennas for electronic device 10. Antennas may also be formed using an antenna ground plane and/or an antenna resonating element formed from conductive housing structures (e.g., internal and/or external structures, support plate structures, etc.).

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a handheld device such as a cellular telephone, a media player, or other small portable device. Device 10 may also be a set-top box, a desktop computer, a display into which a computer or other processing circuitry has been integrated, a display without an integrated computer, a wireless access point, a wireless base station, an electronic device incorporated into a kiosk, building, or vehicle, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material (e.g., glass, ceramic, plastic, sapphire, etc.). In other situations, housing 12 or at least some of the structures that make up housing 12 may be formed from metal elements.

Device 10 may, if desired, have a display such as display 14. Display 14 may be mounted on the front face of device 10. Display 14 may be a touch screen that incorporates capacitive touch electrodes or may be insensitive to touch. The rear face of housing 12 (i.e., the face of device 10 opposing the front face of device 10) may have a substantially planar housing wall such as rear housing wall 12R (e.g., a planar housing wall). Rear housing wall 12R may have slots that pass entirely through the rear housing wall and that therefore separate portions of housing 12 from each other. Rear housing wall 12R may include conductive portions and/or dielectric portions. If desired, rear housing wall 12R may include a planar metal layer covered by a thin layer or coating of dielectric such as glass, plastic, sapphire, or ceramic. Housing 12 may also have shallow grooves that do not pass entirely through housing 12. The slots and grooves may be filled with plastic or other dielectric. If desired, portions of housing 12 that have been separated from each other (e.g., by a through slot) may be joined by internal conductive structures (e.g., sheet metal or other metal members that bridge the slot).

Housing 12 may include peripheral housing structures such as peripheral structures 12W. Peripheral structures 12W and conductive portions of rear housing wall 12R may sometimes be referred to herein collectively as conductive structures of housing 12. Peripheral structures 12W may run around the periphery of device 10 and display 14. In configurations in which device 10 and display 14 have a rectangular shape with four edges, peripheral structures 12W may be implemented using peripheral housing structures that have a rectangular ring shape with four corresponding edges and that extend from rear housing wall 12R to the front face of device 10 (as an example). Peripheral structures 12W or part of peripheral structures 12W may serve as a bezel for display 14 (e.g., a cosmetic trim that surrounds all four sides of display 14 and/or that helps hold display 14 to device 10) if desired. Peripheral structures 12W may, if desired, form sidewall structures for device 10 (e.g., by forming a metal band with vertical sidewalls, curved sidewalls, etc.).

Peripheral structures 12W may be formed of a conductive material such as metal and may therefore sometimes be referred to as peripheral conductive housing structures, conductive housing structures, peripheral metal structures, peripheral conductive sidewalls, peripheral conductive sidewall structures, conductive housing sidewalls, peripheral conductive housing sidewalls, sidewalls, sidewall structures, or a peripheral conductive housing member (as examples). Peripheral conductive housing structures 12W may be formed from a metal such as stainless steel, aluminum, or other suitable materials. One, two, or more than two separate structures may be used in forming peripheral conductive housing structures 12W.

It is not necessary for peripheral conductive housing structures 12W to have a uniform cross-section. For example, the top portion of peripheral conductive housing structures 12W may, if desired, have an inwardly protruding lip that helps hold display 14 in place. The bottom portion of peripheral conductive housing structures 12W may also have an enlarged lip (e.g., in the plane of the rear surface of device 10). Peripheral conductive housing structures 12W may have substantially straight vertical sidewalls, may have sidewalls that are curved, or may have other suitable shapes. In some configurations (e.g., when peripheral conductive housing structures 12W serve as a bezel for display 14), peripheral conductive housing structures 12W may run around the lip of housing 12 (i.e., peripheral conductive housing structures 12W may cover only the edge of housing 12 that surrounds display 14 and not the rest of the sidewalls of housing 12).

Rear housing wall 12R may lie in a plane that is parallel to display 14. In configurations for device 10 in which some or all of rear housing wall 12R is formed from metal, it may be desirable to form parts of peripheral conductive housing structures 12W as integral portions of the housing structures forming rear housing wall 12R. For example, rear housing wall 12R of device 10 may include a planar metal structure and portions of peripheral conductive housing structures 12W on the sides of housing 12 may be formed as flat or curved vertically extending integral metal portions of the planar metal structure (e.g., housing structures 12R and 12W may be formed from a continuous piece of metal in a unibody configuration). Housing structures such as these may, if desired, be machined from a block of metal and/or may include multiple metal pieces that are assembled together to form housing 12. Rear housing wall 12R may have one or more, two or more, or three or more portions. Peripheral conductive housing structures 12W and/or conductive portions of rear housing wall 12R may form one or more exterior surfaces of device 10 (e.g., surfaces that are visible to a user of device 10) and/or may be implemented using internal structures that do not form exterior surfaces of device 10 (e.g., conductive housing structures that are not visible to a user of device 10 such as conductive structures that are covered with layers such as thin cosmetic layers, protective coatings, and/or other coating layers that may include dielectric materials such as glass, ceramic, plastic, or other structures that form the exterior surfaces of device 10 and/or serve to hide peripheral conductive housing structures 12W and/or conductive portions of rear housing wall 12R from view of the user).

Display 14 may have an array of pixels that form an active area AA that displays images for a user of device 10. For example, active area AA may include an array of display pixels. The array of pixels may be formed from liquid crystal display (LCD) components, an array of electrophoretic pixels, an array of plasma display pixels, an array of organic light-emitting diode display pixels or other light-emitting diode pixels, an array of electrowetting display pixels, or display pixels based on other display technologies. If desired, active area AA may include touch sensors such as touch sensor capacitive electrodes, force sensors, or other sensors for gathering a user input.

Display 14 may have an inactive border region that runs along one or more of the edges of active area AA. Inactive area IA may be free of pixels for displaying images and may overlap circuitry and other internal device structures in housing 12. To block these structures from view by a user of device 10, the underside of the display cover layer or other layers in display 14 that overlap inactive area IA may be coated with an opaque masking layer in inactive area IA. The opaque masking layer may have any suitable color.

Display 14 may be protected using a display cover layer such as a layer of transparent glass, clear plastic, transparent ceramic, sapphire, or other transparent crystalline material, or other transparent layer(s). The display cover layer may have a planar shape, a convex curved profile, a shape with planar and curved portions, a layout that includes a planar main area surrounded on one or more edges with a portion that is bent out of the plane of the planar main area, or other suitable shapes. The display cover layer may cover the entire front face of device 10. In another suitable arrangement, the display cover layer may cover substantially all of the front face of device 10 or only a portion of the front face of device 10. Openings may be formed in the display cover layer. For example, an opening may be formed in the display cover layer to accommodate a button. An opening may also be formed in the display cover layer to accommodate ports such as speaker port 16 or a microphone port. Openings may be formed in housing 12 to form communications ports (e.g., an audio jack port, a digital data port, etc.) and/or audio ports for audio components such as a speaker and/or a microphone if desired.

Display 14 may include conductive structures such as an array of capacitive electrodes for a touch sensor, conductive lines for addressing pixels, driver circuits, etc. Housing 12 may include internal conductive structures such as metal frame members and a planar conductive housing member (sometimes referred to as a backplate) that spans the walls of housing 12 (i.e., a substantially rectangular sheet formed from one or more metal parts that is welded or otherwise connected between opposing sides of peripheral conductive structures 12W). The backplate may form an exterior rear surface of device 10 or may be covered by layers such as thin cosmetic layers, protective coatings, and/or other coatings that may include dielectric materials such as glass, ceramic, plastic, or other structures that form the exterior surfaces of device 10 and/or serve to hide the backplate from view of the user. Device 10 may also include conductive structures such as printed circuit boards, components mounted on printed circuit boards, and other internal conductive structures. These conductive structures, which may be used in forming a ground plane in device 10, may extend under active area AA of display 14, for example.

In regions 22 and 20, openings may be formed within the conductive structures of device 10 (e.g., between peripheral conductive housing structures 12W and opposing conductive ground structures such as conductive portions of rear housing wall 12R, conductive traces on a printed circuit board, conductive electrical components in display 14, etc.). These openings, which may sometimes be referred to as gaps, may be filled with air, plastic, and/or other dielectrics and may be used in forming slot antenna resonating elements for one or more antennas in device 10, if desired.

Conductive housing structures and other conductive structures in device 10 may serve as a ground plane for the antennas in device 10. The openings in regions 22 and 20 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 22 and 20. If desired, the ground plane that is under active area AA of display 14 and/or other metal structures in device 10 may have portions that extend into parts of the ends of device 10 (e.g., the ground may extend towards the dielectric-filled openings in regions 22 and 20), thereby narrowing the slots in regions 22 and 20.

In general, device 10 may include any suitable number of antennas (e.g., one or more, two or more, three or more, four or more, etc.). The antennas in device 10 may be located at opposing first and second ends of an elongated device housing (e.g., ends at regions 22 and 20 of device 10 of FIG. 1), along one or more edges of a device housing, in the center of a device housing, in other suitable locations, or in one or more of these locations. The arrangement of FIG. 1 is merely illustrative.

Portions of peripheral conductive housing structures 12W may be provided with peripheral gap structures. For example, peripheral conductive housing structures 12W may be provided with one or more gaps such as gaps 18, as shown in FIG. 1. The gaps in peripheral conductive housing structures 12W may be filled with dielectric such as polymer, ceramic, glass, air, other dielectric materials, or combinations of these materials. Gaps 18 may divide peripheral conductive housing structures 12W into one or more peripheral conductive segments. There may be, for example, two peripheral conductive segments in peripheral conductive housing structures 12W (e.g., in an arrangement with two gaps 18), three peripheral conductive segments (e.g., in an arrangement with three gaps 18), four peripheral conductive segments (e.g., in an arrangement with four gaps 18), six peripheral conductive segments (e.g., in an arrangement with six gaps 18), etc. The segments of peripheral conductive housing structures 12W that are formed in this way may form parts of antennas in device 10 if desired. Other dielectric openings may be formed in peripheral conductive housing structures 12W (e.g., dielectric openings other than gaps 18) and may serve as dielectric antenna windows for antennas mounted within the interior of device 10. Antennas within device 10 may be aligned with the dielectric antenna windows for conveying radio-frequency signals through peripheral conductive housing structures 12W.

If desired, openings in housing 12 such as grooves that extend partway or completely through housing 12 may extend across the width of the rear wall of housing 12 and may penetrate through the rear wall of housing 12 to divide the rear wall into different portions. These grooves may also extend into peripheral conductive housing structures 12W and may form antenna slots, gaps 18, and other structures in device 10. Polymer or other dielectric may fill these grooves and other housing openings. In some situations, housing openings that form antenna slots and other structure may be filled with a dielectric such as air.

In order to provide an end user of device 10 with as large of a display as possible (e.g., to maximize an area of the device used for displaying media, running applications, etc.), it may be desirable to increase the amount of area at the front face of device 10 that is covered by active area AA of display 14. Increasing the size of active area AA may reduce the size of inactive area IA within device 10. This may reduce the area behind display 14 that is available for antennas within device 10. For example, active area AA of display 14 may include conductive structures that serve to block radio-frequency signals handled by antennas mounted behind active area AA from radiating through the front face of device 10. It would therefore be desirable to be able to provide antennas that occupy a small amount of space within device 10 (e.g., to allow for as large of a display active area AA as possible) while still allowing the antennas to communicate with wireless equipment external to device 10 with satisfactory efficiency bandwidth.

In a typical scenario, device 10 may have one or more upper antennas and one or more lower antennas (as an example). An upper antenna may, for example, be formed at the upper end of device 10 in region 20. A lower antenna may, for example, be formed at the lower end of device 10 in region 22. Additional antennas may be formed along the edges of housing 12 extending between regions 20 and 22 if desired. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, near-field communications, ultra-wideband communications, etc.

Figure 2:
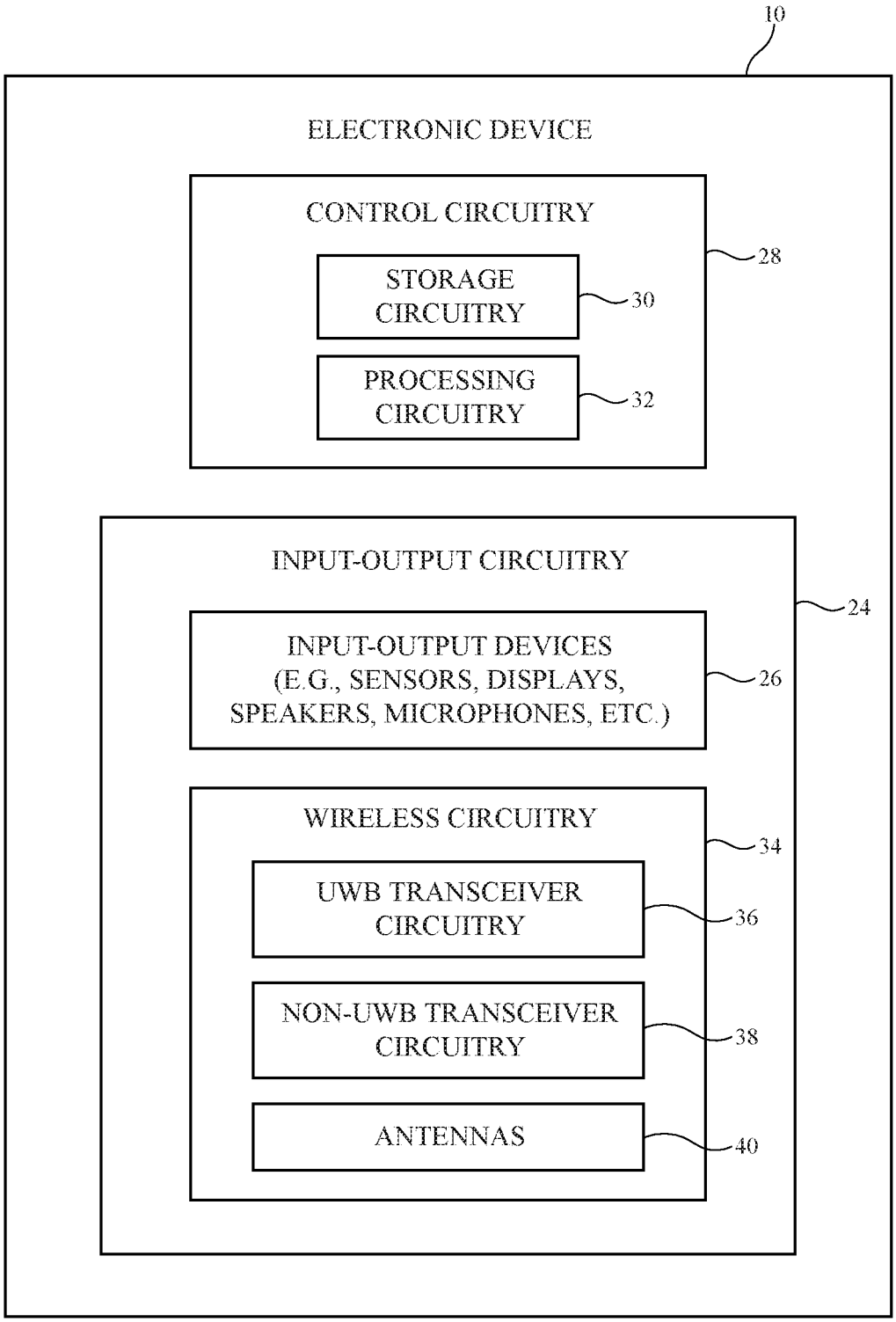
FIG. 2 is a schematic diagram of illustrative circuitry in an electronic device in accordance with some embodiments.

A schematic diagram of illustrative components that may be used in device 10 is shown in FIG. 2. As shown in FIG. 2, device 10 may include control circuitry 28. Control circuitry 28 may include storage such as storage circuitry 30. Storage circuitry 30 may include hard disk drive storage, nonvolatile memory (e.g., flash memory or other electrically-programmable-read-only memory configured to form a solid-state drive), volatile memory (e.g., static or dynamic random-access-memory), etc.

Control circuitry 28 may include processing circuitry such as processing circuitry 32. Processing circuitry 32 may be used to control the operation of device 10. Processing circuitry 32 may include on one or more microprocessors, microcontrollers, digital signal processors, host processors, baseband processor integrated circuits, application specific integrated circuits, central processing units (CPUs), etc. Control circuitry 28 may be configured to perform operations in device 10 using hardware (e.g., dedicated hardware or circuitry), firmware, and/or software. Software code for performing operations in device 10 may be stored on storage circuitry 30 (e.g., storage circuitry 30 may include non-transitory (tangible) computer readable storage media that stores the software code). The software code may sometimes be referred to as program instructions, software, data, instructions, or code. Software code stored on storage circuitry 30 may be executed by processing circuitry 32.

Control circuitry 28 may be used to run software on device 10 such as external node location applications, satellite navigation applications, internet browsing applications, voice-over-internet-protocol (VOIP) telephone call applications, email applications, media playback applications, operating system functions, etc. To support interactions with external equipment, control circuitry 28 may be used in implementing communications protocols. Communications protocols that may be implemented using control circuitry 28 include internet protocols, wireless local area network protocols (e.g., IEEE 802.11 protocols—sometimes referred to as WiFi®), protocols for other short-range wireless communications links such as the Bluetooth® protocol or other WPAN protocols, IEEE 802.1 lad protocols, cellular telephone protocols, MIMO protocols, antenna diversity protocols, satellite navigation system protocols (e.g., global positioning system (GPS) protocols, global navigation satellite system (GLONASS) protocols, etc.), IEEE 802.15.4 ultra-wideband communications protocols or other ultra-wideband communications protocols, etc. Each communications protocol may be associated with a corresponding radio access technology (RAT) that specifies the physical connection methodology used in implementing the protocol.

Device 10 may include input-output circuitry 24. Input-output circuitry 24 may include input-output devices 26. Input-output devices 26 may be used to allow data to be supplied to device 10 and to allow data to be provided from device 10 to external devices. Input-output devices 26 may include user interface devices, data port devices, sensors, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, gyroscopes, accelerometers or other components that can detect motion and device orientation relative to the Earth, capacitance sensors, proximity sensors (e.g., a capacitive proximity sensor and/or an infrared proximity sensor), magnetic sensors, and other sensors and input-output components.

Input-output circuitry 24 may include wireless circuitry such as wireless circuitry 34 (sometimes referred to herein as wireless communications circuitry 34) for wirelessly conveying radio-frequency signals. To support wireless communications, wireless circuitry 34 may include radio-frequency (RF) transceiver circuitry formed from one or more integrated circuits, power amplifier circuitry, low-noise input amplifiers, passive RF components, one or more antennas such as antennas 40, transmission lines, and other circuitry for handling RF wireless signals. Wireless signals can also be sent using light (e.g., using infrared communications).

While control circuitry 28 is shown separately from wireless circuitry 34 in the example of FIG. 2 for the sake of clarity, wireless circuitry 34 may include processing circuitry that forms a part of processing circuitry 32 and/or storage circuitry that forms a part of storage circuitry 30 of control circuitry 28 (e.g., portions of control circuitry 28 may be implemented on wireless circuitry 34). As an example, control circuitry 28 (e.g., processing circuitry 32) may include baseband processor circuitry or other control components that form a part of wireless circuitry 34.

Wireless circuitry 34 may include radio-frequency transceiver circuitry for handling various radio-frequency communications bands. For example, wireless circuitry 34 may include ultra-wideband (UWB) transceiver circuitry 36 that supports communications using the IEEE 802.15.4 protocol and/or other ultra-wideband communications protocols. Ultra-wideband radio-frequency signals may be based on an impulse radio signaling scheme that uses band-limited data pulses. Ultra-wideband signals may have any desired bandwidths such as bandwidths between 499 MHz and 1331 MHz, bandwidths greater than 500 MHz, etc. The presence of lower frequencies in the baseband may sometimes allow ultra-wideband signals to penetrate through objects such as walls. In an IEEE 802.15.4 system, a pair of electronic devices may exchange wireless time stamped messages. Time stamps in the messages may be analyzed to determine the time of flight of the messages and thereby determine the distance (range) between the devices and/or an angle between the devices (e.g., an angle of arrival of incoming radio-frequency signals). Ultra-wideband transceiver circuitry 36 may operate (i.e., convey radio-frequency signals) in frequency bands such as an ultra-wideband communications band between about 5 GHz and about 8.3 GHz (e.g., a 6.5 GHz frequency band, an 8 GHz frequency band, and/or at other suitable frequencies).

As shown in FIG. 2, wireless circuitry 34 may also include non-UWB transceiver circuitry 38. Non-UWB transceiver circuitry 38 may handle communications bands other than UWB communications bands such as 2.4 GHz and 5 GHz bands for Wi-Fi® (IEEE 802.11) communications or communications in other wireless local area network (WLAN) bands, the 2.4 GHz Bluetooth® communications band or other wireless personal area network (WPAN) bands, and/or cellular telephone frequency bands such as a cellular low band (LB) from 600 to 960 MHz, a cellular low-midband (LMB) from 1410 to 1510 MHz, a cellular midband (MB) from 1710 to 2170 MHz, a cellular high band (HB) from 2300 to 2700 MHz, a cellular ultra-high band (UHB) from 3400 to 3600 MHz, or other communications bands between 600 MHz and 4000 MHz or other suitable frequencies (as examples).

Non-UWB transceiver circuitry 38 may handle voice data and non-voice data. Wireless circuitry 34 may include circuitry for other short-range and long-range wireless links if desired. For example, wireless circuitry 34 may include 60 GHz transceiver circuitry (e.g., millimeter wave transceiver circuitry), circuitry for receiving television and radio signals, paging system transceivers, near field communications (NFC) circuitry, etc.

Wireless circuitry 34 may include antennas 40. Antennas 40 may be formed using any suitable types of antenna structures. For example, antennas 40 may include antennas with resonating elements that are formed from loop antenna structures, patch antenna structures, inverted-F antenna structures, slot antenna structures, planar inverted-F antenna structures, helical antenna structures, dipole antenna structures, monopole antenna structures, hybrids of two or more of these designs, etc. If desired, one or more of antennas 40 may be cavity-backed antennas.

Different types of antennas may be used for different bands and combinations of bands. For example, one type of antenna may be used in forming a local wireless link antenna and another type of antenna may be used in forming a remote wireless link antenna. Dedicated antennas may be used for conveying radio-frequency signals in a UWB communications band or, if desired, antennas 40 can be configured to convey both radio-frequency signals in a UWB communications band and radio-frequency signals in a non-UWB communications band (e.g., wireless local area network signals and/or cellular telephone signals). Antennas 40 can include two or more antennas for handling ultra-wideband wireless communication. In one suitable arrangement that is described herein as an example, antennas 40 include one or more pairs of antennas (sometimes referred to herein as doublets of antennas) for handling ultra-wideband wireless communication.

Space is often at a premium in electronic devices such as device 10. In order to minimize space consumption within device 10, the same antenna 40 may be used to cover multiple frequency bands. In one suitable arrangement that is described herein as an example, each antenna 40 that is used to perform ultra-wideband wireless communication may be a multi-band antenna that conveys radio-frequency signals in at least two ultra-wideband communications bands (e.g., the 6.5 GHz band and the 8.0 GHz band). Radio-frequency signals that are conveyed in UWB communications bands (e.g., using a UWB protocol) may sometimes be referred to herein as UWB signals or UWB radio-frequency signals. Radio-frequency signals in frequency bands other than the UWB communications bands (e.g., radio-frequency signals in cellular telephone frequency bands, WPAN frequency bands, WLAN frequency bands, etc.) may sometimes be referred to herein as non-UWB signals or non-UWB radio-frequency signals.

Figure 3:
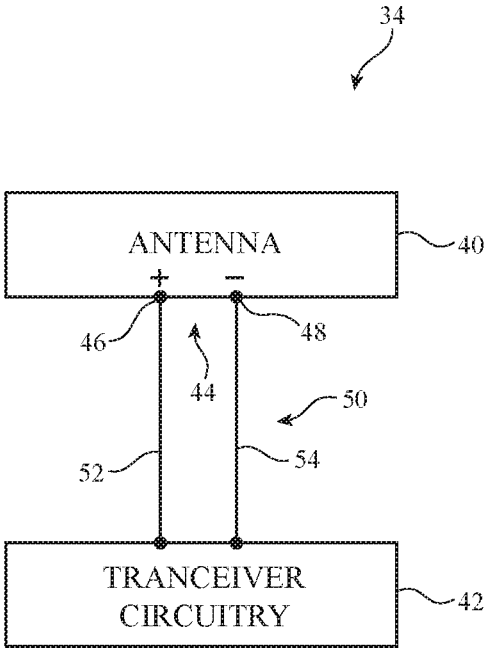
FIG. 3 is a schematic diagram of illustrative wireless circuitry in accordance with some embodiments.

A schematic diagram of wireless circuitry 34 is shown in FIG. 3. As shown in FIG. 3, wireless circuitry 34 may include transceiver circuitry 42 (e.g., UWB transceiver circuitry 36 or non-UWB transceiver circuitry 38 of FIG. 2) that is coupled to a given antenna 40 using a path such as path 50.

To provide antenna structures such as antenna 40 with the ability to cover different frequencies of interest, antenna 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna 40 may be provided with adjustable circuits such as tunable components that tune the antenna over communications (frequency) bands of interest. The tunable components may be part of a tunable filter or tunable impedance matching network, may be part of an antenna resonating element, may span a gap between an antenna resonating element and antenna ground, etc.

Path 50 may include one or more transmission lines. As an example, path 50 of FIG. 3 may be a transmission line having a positive signal conductor such as line 52 and a ground signal conductor such as line 54. Path 50 may sometimes be referred to herein as transmission line 50 or radio-frequency transmission line 50. Line 52 may sometimes be referred to herein as positive signal conductor 52, signal conductor 52, signal line conductor 52, signal line 52, positive signal line 52, signal path 52, or positive signal path 52 of transmission line 50. Line 54 may sometimes be referred to herein as ground signal conductor 54, ground conductor 54, ground line conductor 54, ground line 54, ground signal line 54, ground path 54, or ground signal path 54 of transmission line 50.

Transmission line 50 may, for example, include a coaxial cable transmission line (e.g., ground conductor 54 may be implemented as a grounded conductive braid surrounding signal conductor 52 along its length), a stripline transmission line, a microstrip transmission line, coaxial probes realized by a metalized via, an edge-coupled microstrip transmission line, an edge-coupled stripline transmission line, a waveguide structure (e.g., a coplanar waveguide or grounded coplanar waveguide), combinations of these types of transmission lines and/or other transmission line structures, etc.

Transmission lines in device 10 such as transmission line 50 may be integrated into rigid and/or flexible printed circuit boards. In one suitable arrangement, transmission lines such as transmission line 50 may also include transmission line conductors (e.g., signal conductors 52 and ground conductors 54) integrated within multilayer laminated structures (e.g., layers of a conductive material such as copper and a dielectric material such as a resin that are laminated together without intervening adhesive). The multilayer laminated structures may, if desired, be folded or bent in multiple dimensions (e.g., two or three dimensions) and may maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive).

A matching network may include components such as inductors, resistors, and capacitors used in matching the impedance of antenna 40 to the impedance of transmission line 50. Matching network components may be provided as discrete components (e.g., surface mount technology components) or may be formed from housing structures, printed circuit board structures, traces on plastic supports, etc. Components such as these may also be used in forming filter circuitry in antenna(s) 40 and may be tunable and/or fixed components.

Transmission line 50 may be coupled to antenna feed structures associated with antenna 40. As an example, antenna 40 may form an inverted-F antenna, a slot antenna, a hybrid inverted-F slot antenna or other antenna having an antenna feed 44 with a positive antenna feed terminal such as terminal 46 and a ground antenna feed terminal such as ground antenna feed terminal 48. Signal conductor 52 may be coupled to positive antenna feed terminal 46 and ground conductor 54 may be coupled to ground antenna feed terminal 48. Other types of antenna feed arrangements may be used if desired. For example, antenna 40 may be fed using multiple feeds each coupled to a respective port of transceiver circuitry 42 over a corresponding transmission line. If desired, signal conductor 52 may be coupled to multiple locations on antenna 40 (e.g., antenna 40 may include multiple positive antenna feed terminals coupled to signal conductor 52 of the same transmission line 50). Switches may be interposed on the signal conductor between transceiver circuitry 42 and the positive antenna feed terminals if desired (e.g., to selectively activate one or more positive antenna feed terminals at any given time). The illustrative feeding configuration of FIG. 3 is merely illustrative.

During operation, device 10 may communicate with external wireless equipment. If desired, device 10 may use radio-frequency signals conveyed between device 10 and the external wireless equipment to identify a location of the external wireless equipment relative to device 10. Device 10 may identify the relative location of the external wireless equipment by identifying a range to the external wireless equipment (e.g., the distance between the external wireless equipment and device 10) and the angle of arrival (AoA) of radio-frequency signals from the external wireless equipment (e.g., the angle at which radio-frequency signals are received by device 10 from the external wireless equipment).

Figure 4:
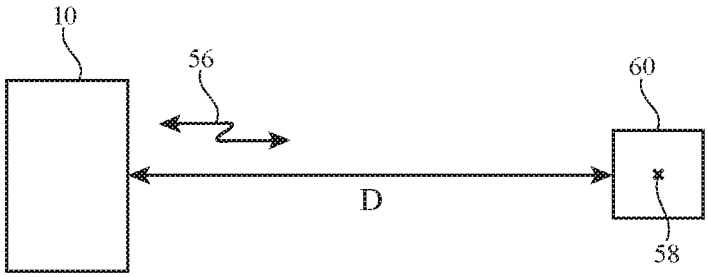
FIG. 4 is a diagram of an illustrative electronic device in wireless communication with an external node in a network in accordance with some embodiments.

FIG. 4 is a diagram showing how device 10 may determine a distance D between device 10 and external wireless equipment such as wireless network node 60 (sometimes referred to herein as wireless equipment 60, wireless device 60, external device 60, or external equipment 60). Node 60 may include devices that are capable of receiving and/or transmitting radio-frequency signals such as radio-frequency signals 56. Node 60 may include tagged devices (e.g., any suitable object that has been provided with a wireless receiver and/or a wireless transmitter), electronic equipment (e.g., an infrastructure-related device), and/or other electronic devices (e.g., devices of the type described in connection with FIG. 1, including some or all of the same wireless communications capabilities as device 10).

For example, node 60 may be a laptop computer, a tablet computer, a somewhat smaller device such as a wrist-watch device, pendant device, headphone device, earpiece device, headset device (e.g., virtual or augmented reality headset devices), or other wearable or miniature device, a handheld device such as a cellular telephone, a media player, or other small portable device. Node 60 may also be a set-top box, a camera device with wireless communications capabilities, a desktop computer, a display into which a computer or other processing circuitry has been integrated, a display without an integrated computer, or other suitable electronic equipment. Node 60 may also be a key fob, a wallet, a book, a pen, or other object that has been provided with a low-power transmitter (e.g., an RFID transmitter or other transmitter). Node 60 may be electronic equipment such as a thermostat, a smoke detector, a Bluetooth® Low Energy (Bluetooth LE) beacon, a Wi-Fi® wireless access point, a wireless base station, a server, a heating, ventilation, and air conditioning (HVAC) system (sometimes referred to as a temperature-control system), a light source such as a light-emitting diode (LED) bulb, a light switch, a power outlet, an occupancy detector (e.g., an active or passive infrared light detector, a microwave detector, etc.), a door sensor, a moisture sensor, an electronic door lock, a security camera, or other device. Device 10 may also be one of these types of devices if desired.

As shown in FIG. 4, device 10 may communicate with node 60 using wireless radio-frequency signals 56. Radio-frequency signals 56 may include Bluetooth® signals, near-field communications signals, wireless local area network signals such as IEEE 802.11 signals, millimeter wave communication signals such as signals at 60 GHz, UWB signals, other radio-frequency wireless signals, infrared signals, etc. In one suitable arrangement that is described herein by example, radio-frequency signals 56 are UWB signals conveyed in multiple UWB communications bands such as the 6.5 GHz and 8 GHz UWB communications bands. Radio-frequency signals 56 may be used to determine and/or convey information such as location and orientation information. For example, control circuitry 28 in device 10 (FIG. 2) may determine the location 58 of node 60 relative to device 10 using radio-frequency signals 56.

In arrangements where node 60 is capable of sending or receiving communications signals, control circuitry 28 (FIG. 2) on device 10 may determine distance D using radio-frequency signals 56 of FIG. 4. The control circuitry may determine distance D using signal strength measurement schemes (e.g., measuring the signal strength of radio-frequency signals 56 from node 60) or using time-based measurement schemes such as time of flight measurement techniques, time difference of arrival measurement techniques, angle of arrival measurement techniques, triangulation methods, time-of-flight methods, using a crowdsourced location database, and other suitable measurement techniques. This is merely illustrative, however. If desired, the control circuitry may use information from Global Positioning System receiver circuitry, proximity sensors (e.g., infrared proximity sensors or other proximity sensors), image data from a camera, motion sensor data from motion sensors, and/or using other circuitry on device 10 to help determine distance D. In addition to determining the distance D between device 10 and node 60, the control circuitry may determine the orientation of device 10 relative to node 60.

Figure 5:
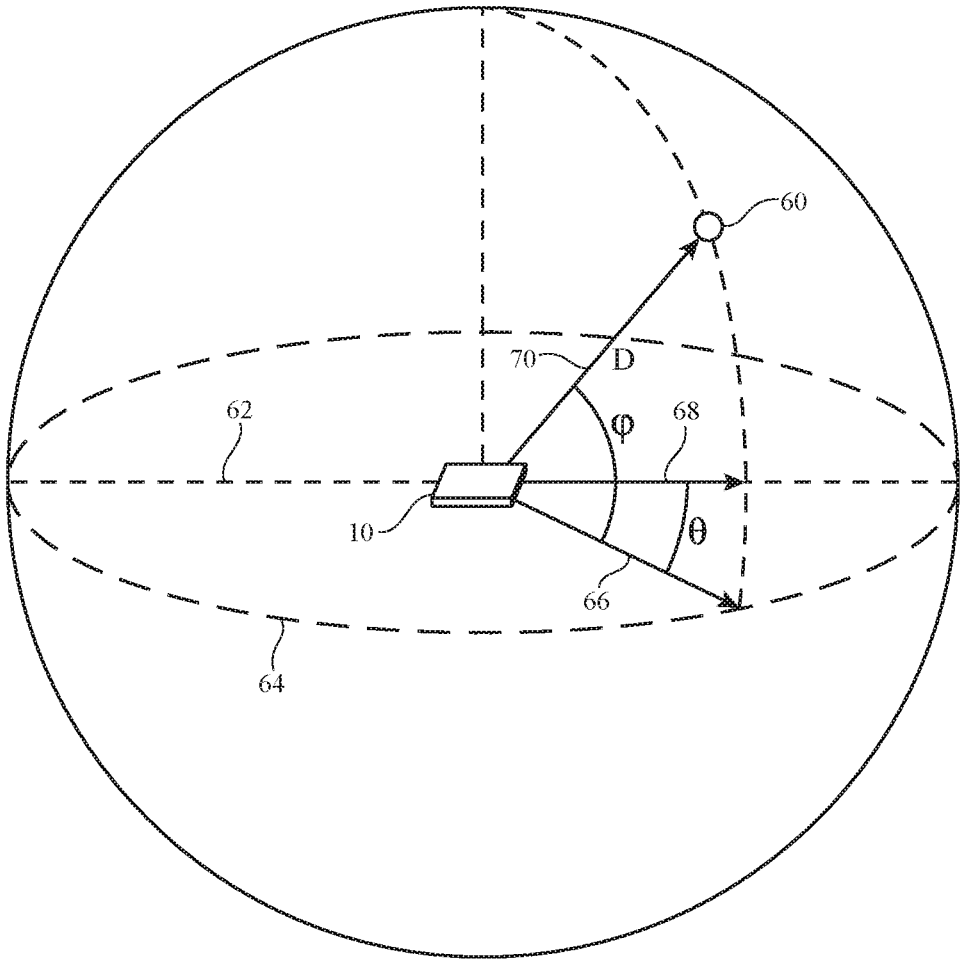
FIG. 5 is a diagram showing how the location (e.g., range and angle of arrival) of an external node in a network may be determined relative to an electronic device in accordance with some embodiments.

FIG. 5 illustrates how the position and orientation of device 10 relative to nearby nodes such as node 60 may be determined. In the example of FIG. 5, the control circuitry on device 10 (e.g., control circuitry 28 of FIG. 2) uses a horizontal polar coordinate system to determine the location and orientation of device 10 relative to node 60. In this type of coordinate system, the control circuitry may determine an azimuth angle θ and/or an elevation angle φ to describe the position of nearby nodes 60 relative to device 10. The control circuitry may define a reference plane such as local horizon 64 and a reference vector such as reference vector 68. Local horizon 64 may be a plane that intersects device 10 and that is defined relative to a surface of device 10 (e.g., the front or rear face of device 10). For example, local horizon 64 may be a plane that is parallel to or coplanar with display 14 of device 10 (FIG. 1). Reference vector 68 (sometimes referred to as the "north" direction) may be a vector in local horizon 64. If desired, reference vector 68 may be aligned with longitudinal axis 62 of device 10 (e.g., an axis running lengthwise down the center of device 10 and parallel to the longest rectangular dimension of device 10, parallel to the Y-axis of FIG. 1). When reference vector 68 is aligned with longitudinal axis 62 of device 10, reference vector 68 may correspond to the direction in which device 10 is being pointed.

Azimuth angle θ and elevation angle φ may be measured relative to local horizon 64 and reference vector 68. As shown in FIG. 5, the elevation angle φ (sometimes referred to as altitude) of node 60 is the angle between node 60 and local horizon 64 of device 10 (e.g., the angle between vector 70 extending between device 10 and node 60 and a coplanar vector 66 extending between device 10 and local horizon 64). The azimuth angle θ of node 60 is the angle of node 60 around local horizon 64 (e.g., the angle between reference vector 68 and vector 66). In the example of FIG. 5, the azimuth angle θ and elevation angle φ of node 60 are greater than 0°.

If desired, other axes besides longitudinal axis 62 may be used to define reference vector 68. For example, the control circuitry may use a horizontal axis that is perpendicular to longitudinal axis 62 as reference vector 68. This may be useful in determining when nodes 60 are located next to a side portion of device 10 (e.g., when device 10 is oriented side-to-side with one of nodes 60).

After determining the orientation of device 10 relative to node 60, the control circuitry on device 10 may take suitable action. For example, the control circuitry may send information to node 60, may request and/or receive information from 60, may use display 14 (FIG. 1) to display a visual indication of wireless pairing with node 60, may use speakers to generate an audio indication of wireless pairing with node 60, may use a vibrator, a haptic actuator, or other mechanical element to generate haptic output indicating wireless pairing with node 60, may use display 14 to display a visual indication of the location of node 60 relative to device 10, may use speakers to generate an audio indication of the location of node 60, may use a vibrator, a haptic actuator, or other mechanical element to generate haptic output indicating the location of node 60, and/or may take other suitable action.

In one suitable arrangement, device 10 may determine the distance between the device 10 and node 60 and the orientation of device 10 relative to node 60 using two or more ultra-wideband antennas. The ultra-wide band antennas may receive radio-frequency signals from node 60 (e.g., radio-frequency signals 56 of FIG. 4). Time stamps in the wireless communication signals may be analyzed to determine the time of flight of the wireless communication signals and thereby determine the distance (range) between device 10 and node 60. Additionally, angle of arrival (AoA) measurement techniques may be used to determine the orientation of electronic device 10 relative to node 60 (e.g., azimuth angle θ and elevation angle φ).

In angle of arrival measurement, node 60 transmits a radio-frequency signal to device 10 (e.g., radio-frequency signals 56 of FIG. 4). Device 10 may measure a delay in arrival time of the radio-frequency signals between the two or more ultra-wideband antennas. The delay in arrival time (e.g., the difference in received phase at each ultra-wideband antenna) can be used to determine the angle of arrival of the radio-frequency signal (and therefore the angle of node 60 relative to device 10). Once distance D and the angle of arrival have been determined, device 10 may have knowledge of the precise location of node 60 relative to device 10.

Figure 6:
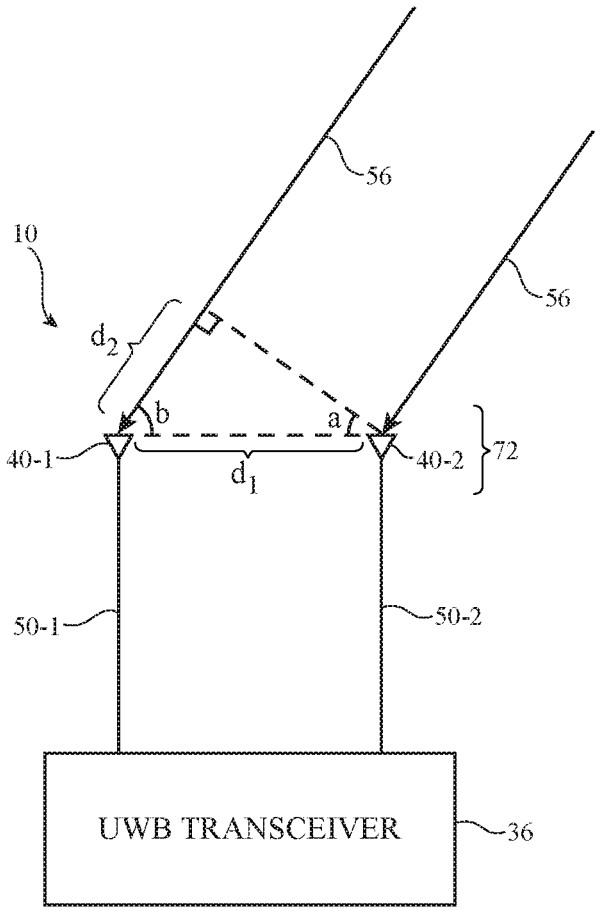
FIG. 6 is a diagram showing how illustrative antennas in an electronic device may be used for detecting angle of arrival in accordance with some embodiments.

FIG. 6 is a schematic diagram showing how angle of arrival measurement techniques may be used to determine the orientation of device 10 relative to node 60. As shown in FIG. 6, device 10 may include multiple antennas (e.g., a first antenna 40-1 and a second antenna 40-2) coupled to UWB transceiver circuitry 36 over respective transmission lines (e.g., a first transmission line 50-1 and a second transmission line 50-2).

Antennas 40-1 and 40-2 may each receive radio-frequency signals 56 from node 60 (FIG. 5). Antennas 40-1 and 40-2 may be laterally separated by a distance $d_1$, where antenna 40-1 is farther away from node 60 than antenna 40-2 (in the example of FIG. 6). Therefore, radio-frequency signals 56 travel a greater distance to reach antenna 40-1 than antenna 40-2. The additional distance between node 60 and antenna 40-1 is shown in FIG. 6 as distance $d_2$. FIG. 6 also shows angles a and b (where a+b=90°).

Distance $d_2$ may be determined as a function of angle a or angle b (e.g., $d_2=d_1*\sin(a)$ or $d_2=d_1*\cos(b)$). Distance $d_2$ may also be determined as a function of the phase difference between the signal received by antenna 40-1 and the signal received by antenna 40-2 (e.g., $d_2=(PD)*\lambda/(2*\pi)$), where PD is the phase difference (sometimes written "Δφ") between the signal received by antenna 40-1 and the signal received by antenna 40-2, and h is the wavelength of radio-frequency signals 56. Device 10 may include phase measurement circuitry coupled to each antenna to measure the phase of the received signals and to identify phase difference PD (e.g., by subtracting the phase measured for one antenna from the phase measured for the other antenna). The two equations for $d_2$ may be set equal to each other (e.g., $d_1*\sin(a)=(PD)*\lambda/(2*\pi)$) and rearranged to solve for the angle a (e.g., $a=\sin^{-1}((PD)*\lambda/(2*\pi*d_1))$ or the angle b. Therefore, the angle of arrival may be determined (e.g., by control circuitry 28 of FIG. 2) based on the known (predetermined) distance $d_1$ between antennas 40-1 and 40-2, the detected (measured) phase difference PD between the signal received by antenna 40-1 and the signal received by antenna 40-2, and the known wavelength (frequency) of the received radio-frequency signals 56. Angles a and/or b of FIG. 6 may be converted to spherical coordinates to obtain azimuth angle θ and elevation angle φ of FIG. 5, for example. Control circuitry 28 (FIG. 2) may determine the angle of arrival of radio-frequency signals 56 by calculating one or both of azimuth angle θ and elevation angle φ.

Distance $d_1$ may be selected to ease the calculation for phase difference PD between the signal received by antenna 40-1 and the signal received by antenna 40-2. For example, $d_1$ may be less than or equal to one half of the wavelength (e.g., effective wavelength) of the received radio-frequency signals 56 (e.g., to avoid multiple phase difference solutions).

With two antennas for determining angle of arrival (as in FIG. 6), the angle of arrival within a single plane may be determined. For example, antennas 40-1 and 40-2 in FIG. 6 may be used to determine azimuth angle θ of FIG. 5. A third antenna may be included to enable angle of arrival determination in multiple planes (e.g., azimuth angle θ and elevation angle φ of FIG. 5 may both be determined).

Antennas 40-1 and 40-2 may be referred to collectively herein as a doublet 72 of antennas 40. Doublets 72 of antennas 40 may be used to determine angle of arrival within a single plane (e.g., to determine one of azimuth angle θ or elevation angle φ of FIG. 5). If desired, three antennas 40 may be arranged in a triplet of antennas (e.g., where each antenna is arranged to lie on a respective corner of a right triangle). Triplets of antennas 40 may be used to determine angle of arrival in two planes (e.g., to determine both azimuth angle θ and elevation angle φ of FIG. 5). In electronic devices such as device 10, where space is at a premium, doublets of antennas may be placed at a greater number of potential locations in device 10 than triplets of antennas (e.g., because triplets of antennas occupy more space than doublets of antennas). If desired, different doublets of antennas may be oriented orthogonally with respect to each other in device 10 to recover angle of arrival in two dimensions (e.g., using two or more orthogonal doublets of antennas 40 that each measure angle of arrival in a single respective plane).

Any desired antenna structures may be used for implementing antennas 40-1 and 40-2 of FIG. 6. In one suitable arrangement that is sometimes described herein as an example, slot antenna structures may be used for implementing antennas 40-1 and 40-2. Antennas that are implemented using slot antenna structures may sometimes be referred to herein as slot antennas. The slot antennas may be configured to radiate in multiple UWB communications bands (e.g., the 6.5 GHz UWB band and the 8.0 GHz UWB band). An illustrative slot antenna that radiates in multiple UWB communications bands is shown in FIG. 7.

Figure 7:
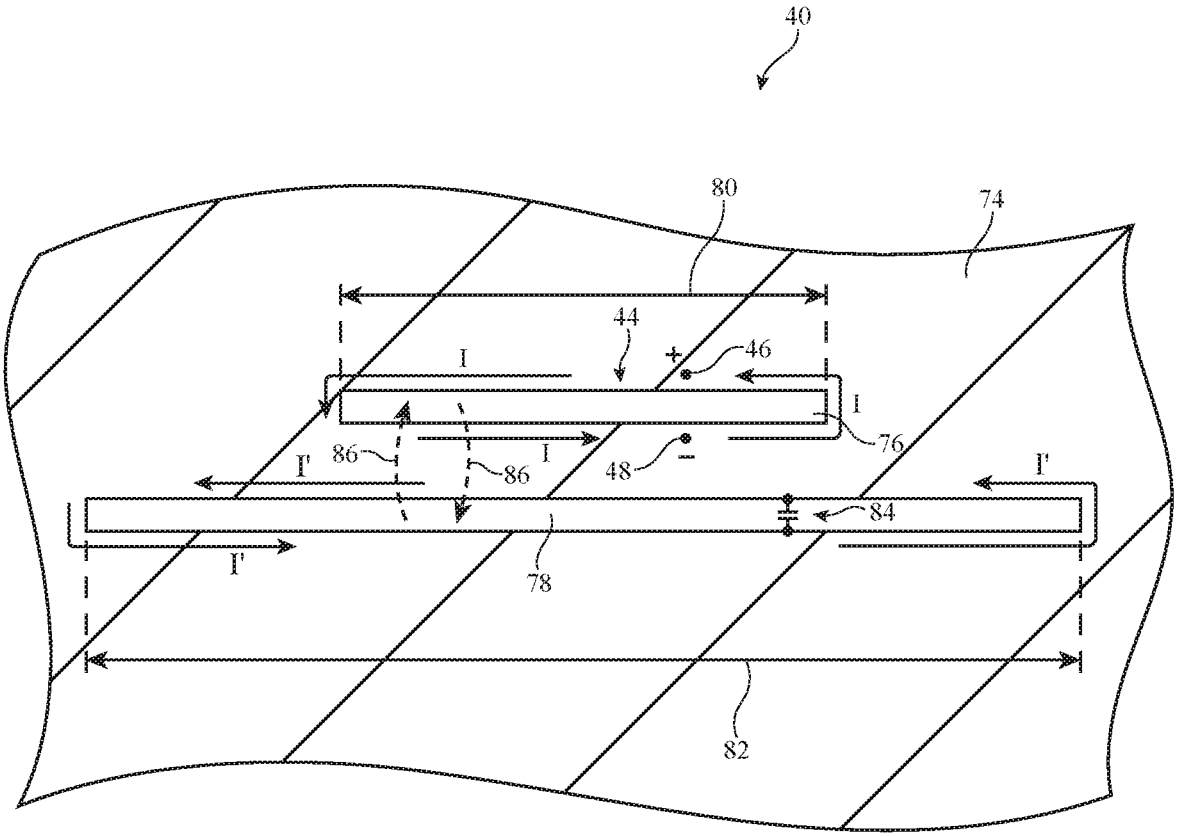
FIG. 7 is a diagram of an illustrative multi-band antenna for performing angle of arrival and range detection operations in accordance with some embodiments.

As shown in FIG. 7, antenna 40 (e.g., a given one of antennas 40-1 and 40-2 of FIG. 6) may include a conductive structure such as structure 74 that has been provided with dielectric-filled openings such as dielectric opening 76 and dielectric opening 78. Openings such as openings 76 and 78 of FIG. 5 are sometimes referred to as slots, slot elements, slot radiating elements, slot resonating elements, or slot antenna resonating elements of antenna 40. In the configuration of FIG. 7, slots 76 and 78 are both closed slots, because portions of conductive structure 74 completely surround and enclose slots 76 and 78. Open slot antenna structures may also be formed in conductive materials such as conductive structure 74 (e.g., by forming an opening in the right-hand left-hand end of conductive structure 74 so that slots 76 and/or 78 protrude through conductive structure 74). Slots 76 and 78 may be parallel slots that extend along parallel longitudinal axes. Forming antenna 40 with two slots 76 and 78 may allow antenna 40 to exhibit response peaks in multiple frequency (communications) bands. If desired, antenna 40 may include only slot 76 (e.g., slot 78 may be omitted). In this scenario, antenna 40 may cover only a single frequency band (e.g., a single UWB communications band).

As shown in FIG. 7, antenna 40 may be feed using antenna feed 44 coupled across slot 76. In particular, positive antenna feed terminal 46 and ground antenna feed terminal 48 of antenna feed 44 may be coupled to opposing sides of slot 76 along the length 80 of slot 76. Antenna current I may flow between antenna feed terminals 46 and 48 around the perimeter of slot 76. Corresponding radio-frequency signals may be radiated by slot 76. Similarly, radio-frequency signals received by antenna 40 may produce antenna currents I around slot 76.

Antenna feed 44 may be coupled across slot 76 at a distance from the left or right edge (side) of slot 76 that is selected to match the impedance of antenna 40 to the impedance of the corresponding transmission line (e.g., transmission line 50 of FIG. 3). For example, antenna current I flowing around slot 76 may experience an impedance of zero at the left and right edges of slot 76 (e.g., a short circuit impedance) and an infinite (open circuit) impedance at the center of slot 76 (e.g., at a fundamental frequency of the slot). Antenna feed 44 may be located between the center of slot 76 and one of the left or right edges at a location where antenna current I experiences an impedance that matches the impedance of the corresponding transmission line (e.g., 50 Ohms).

In scenarios where slot 76 is a closed slot, length 80 may be approximately equal to (e.g., within 15% of) one-half of a first wavelength of operation of the antenna (e.g., a wavelength corresponding to a frequency in a first UWB communications band). Harmonic modes of slot 76 may also be configured to cover desired frequency bands. In scenarios where slot 76 is an open slot, the length of slot 76 may be approximately equal to one-quarter of the first wavelength of operation of the antenna. The first wavelength of operation may, for example, be an effective wavelength of operation that is modified from a free-space wavelength by a constant value that is determined by the dielectric material within slot 76.

Antenna current I may parasitically excite antenna current I' to flow around the perimeter of slot 78 (e.g., slot 76 may serve as an indirect antenna feed for slot 78 and may indirectly feed slot 78 via near-field electromagnetic coupling 86, whereas slot 76 is directly fed by antenna feed 44). While slot 76 has a length 80 that configures slot 76 to radiate radio-frequency signals in a first UWB communications band, slot 78 may have a length 82 that configures slot 78 to radiate radio-frequency signals in a second UWB communications band. Length 82 may be approximately equal to one-half of a second wavelength of operation of the antenna (e.g., a wavelength corresponding to a frequency in the second UWB communications band). The second UWB communications band may include lower frequencies than the first UWB communications band covered by slot 76 (e.g., because length 82 is greater than length 80). As one example, length 80 may be selected so that slot 76 radiates in the 8.0 GHz UWB band and length 82 may be selected so that slot 78 radiates in the 6.5 GHz UWB band (e.g., so that antenna 40 radiates with antenna efficiencies greater than a minimum threshold efficiency in both the 6.5 GHz and 8.0 GHz UWB bands).

The frequency response of slot 78 can be tuned using one or more tuning components. For example, as shown in FIG. 7, a tuning component such as capacitor 84 may be coupled across slot 78. Capacitor 84 may have terminals that are coupled to conductive structure 74 at opposing sides of slot 78. Capacitor 84 may serve to lower the resonating frequency of slot 78 so that length 82 is shorter than one-half of the second wavelength of operation of antenna 40. This may, for example, serve to minimize the space within device 10 occupied by antenna 40. Capacitor 84 may also perform impedance matching functions for antenna 40. The example of FIG. 7 is merely illustrative. Other components such as inductors may be coupled across slot 78. One or more tuning components such as inductors and/or capacitors may be coupled across slot 76. Slots 76 and 78 may have any other desired shapes (e.g., shapes having curved and/or straight edges, shapes following meandering paths, shapes following paths having multiple branches, etc.)

By using slot 76 to indirectly feed slot 78, antenna 40 may cover both the 6.5 GHz UWB band and the 8.0 UWB band with satisfactory antenna efficiency and without requiring an additional set of antenna feed terminals to feed slot 78. This may allow antenna 40 to be fed using only a single transmission line (e.g., the transmission line coupled to antenna feed 44), thereby minimizing the routing complexity required to feed antenna 40 and the amount of space required to implement antenna 40 within device 10. If desired, antenna 40 may be a cavity-backed antenna having a conductive cavity located behind slots 76 and 78. The conductive cavity may help to shield antenna 40 from electromagnetic interference with other components in device 10 and may help to optimize the uniformity of the radiation pattern for antenna 40.

Figure 8:
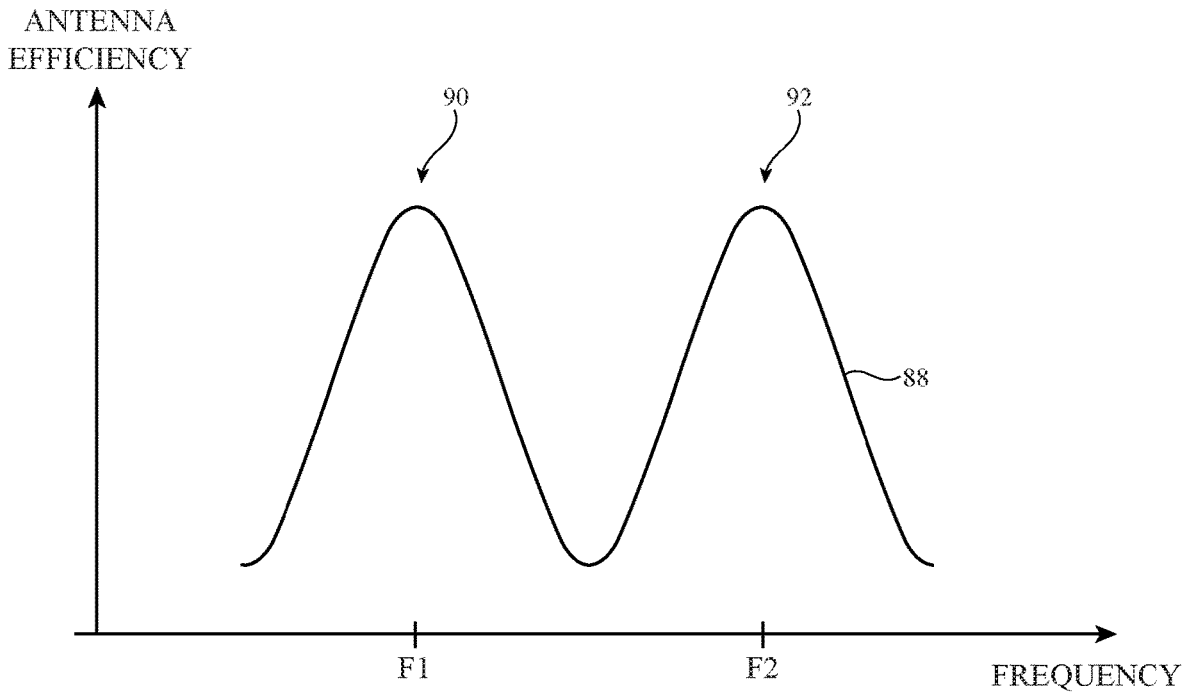
FIG. 8 is a plot of antenna performance (antenna efficiency) for an illustrative multi-band antenna of the type shown in FIG. 7 in accordance with some embodiments.

FIG. 8 is a graph in which antenna performance (antenna efficiency) has been plotted as a function of operating frequency for antenna 40 of FIG. 7. As shown in FIG. 8, curve 88 plots an exemplary antenna efficiency of antenna 40. As shown by curve 88, antenna 40 may exhibit a first response peak 90 at frequency F1. Frequency F1 may lie in the UWB communications band covered by slot 78 of FIG. 7 (e.g., slot 78 may produce peak 90 of curve 88). Antenna 40 may exhibit a second response peak 92 at frequency F2. Frequency F2 may lie in the UWB communications band covered by slot 76 of FIG. 7 (e.g., slot 76 may produce peak 92 of curve 88). Frequencies F1 and F2 may lie within any desired UWB communications bands. For example, frequency F1 may be 6.5 GHz whereas frequency F2 is 8.0 GHz.

The example of FIG. 8 is merely illustrative. In general, curve 88 may have other shapes if desired (e.g., response peaks 90 and 92 may lie at any desired frequencies and may have other bandwidths). Antenna 40 may cover more than two UWB communications bands if desired (e.g., antenna 40 may include any desired number of slots such as three slots, four slots, more than four slots, etc.).

Figure 9:
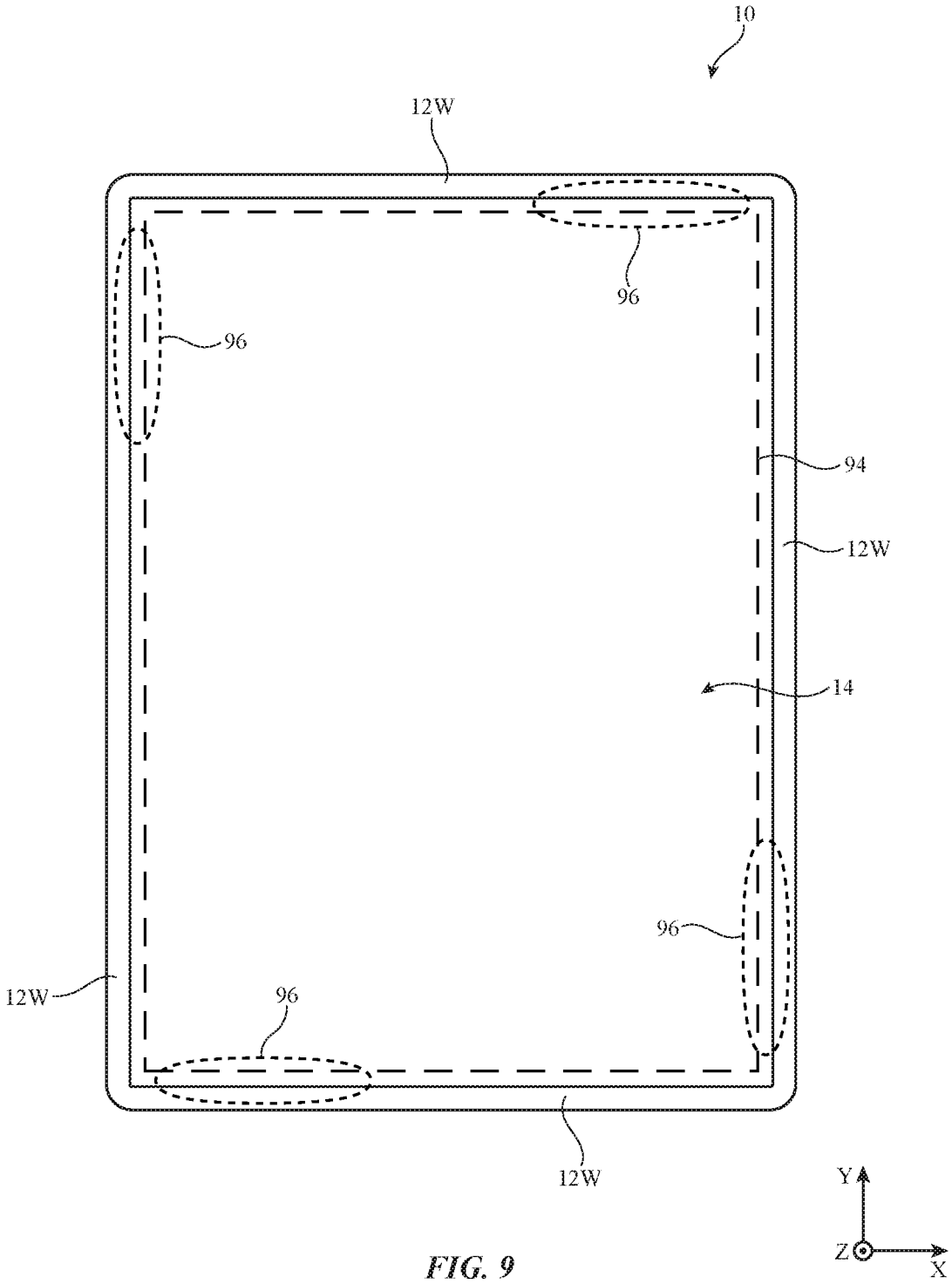
FIG. 9 is a top-down view of an illustrative electronic device having multiple doublets of multi-band antennas that are used in performing angle of arrival and range detection operations in accordance with some embodiments.

Multiple doublets of antennas (e.g., doublets such as doublet 72 of FIG. 6) may be located at different locations on device 10. FIG. 9 is a top view of device 10 showing different illustrative locations for forming multiple doublets of antennas. As shown in FIG. 9, device 10 may include peripheral conductive housing structures 12W (e.g., four peripheral conductive housing sidewalls that surround the rectangular periphery of device 10). Display 14 may have a display module such as display module 94. Peripheral conductive housing structures 12W may run around the periphery of display module 94 (e.g., along all four sides of device 10). Display module 94 may be covered by a display cover layer (not shown). The display cover layer may extend across the entire length and width of device 10 and may, if desired, be mounted to or otherwise supported by peripheral conductive housing structures 12W.

Display module 94 (sometimes referred to as a display panel, active display circuitry, or active display structures) may be any desired type of display panel and may include pixels formed from light-emitting diodes (LEDs), organic LEDs (OLEDs), plasma cells, electrowetting pixels, electrophoretic pixels, liquid crystal display (LCD) components, or other suitable pixel structures. The lateral area of display module 94 may, for example, determine the size of the active area of display 14 (e.g., active area AA of FIG. 1). Display module 94 may include active light emitting components, touch sensor components (e.g., touch sensor electrodes), force sensor components, and/or other active components. Because display module 94 includes conductive components, display module 94 may serve to block radio-frequency signals from passing through display 14. Doublets of antennas may therefore be located within regions 96 around the periphery of display module 94 and device 10. Each region 96 of FIG. 9 may, for example, include a corresponding doublet 72 of antennas 40-1 and 40-2 (FIG. 6). Dielectric antenna windows may be formed within peripheral conductive housing structures 12W within regions 96 to allow the doublets of antennas in regions 96 to convey radio-frequency signals with the exterior of device 10.

In the example of FIG. 9, each region 96 is located along a respective side (edge) of device 10. This may allow the doublets of antennas to collectively cover all angles around device 10 (e.g., a full sphere around device 10). The doublet of antennas within each region 96 may receive radio-frequency signals that are used to identify angle of arrival within a single corresponding plane (e.g., to identify one of azimuth angle θ or an elevation angle φ of FIG. 5). The doublets of antennas along the top and bottom edges of device 10 may be oriented perpendicular to the doublets of antennas along the left and right edges of device 10. The doublets of antennas in each region 96 may therefore be used to collectively obtain angle of arrival within two orthogonal planes (e.g., to determine both azimuth angle θ and elevation angle φ of FIG. 5). The example of FIG. 9 is merely illustrative. Each edge of device 10 may include multiple regions 96 and some edges of device 10 may include no regions 96. If desired, additional regions 96 may be located elsewhere on device 10 (e.g., for radiating through the front face of device 10 such as through inactive area IA of FIG. 1, for radiating through the rear face of device 10, etc.).

Figure 10:
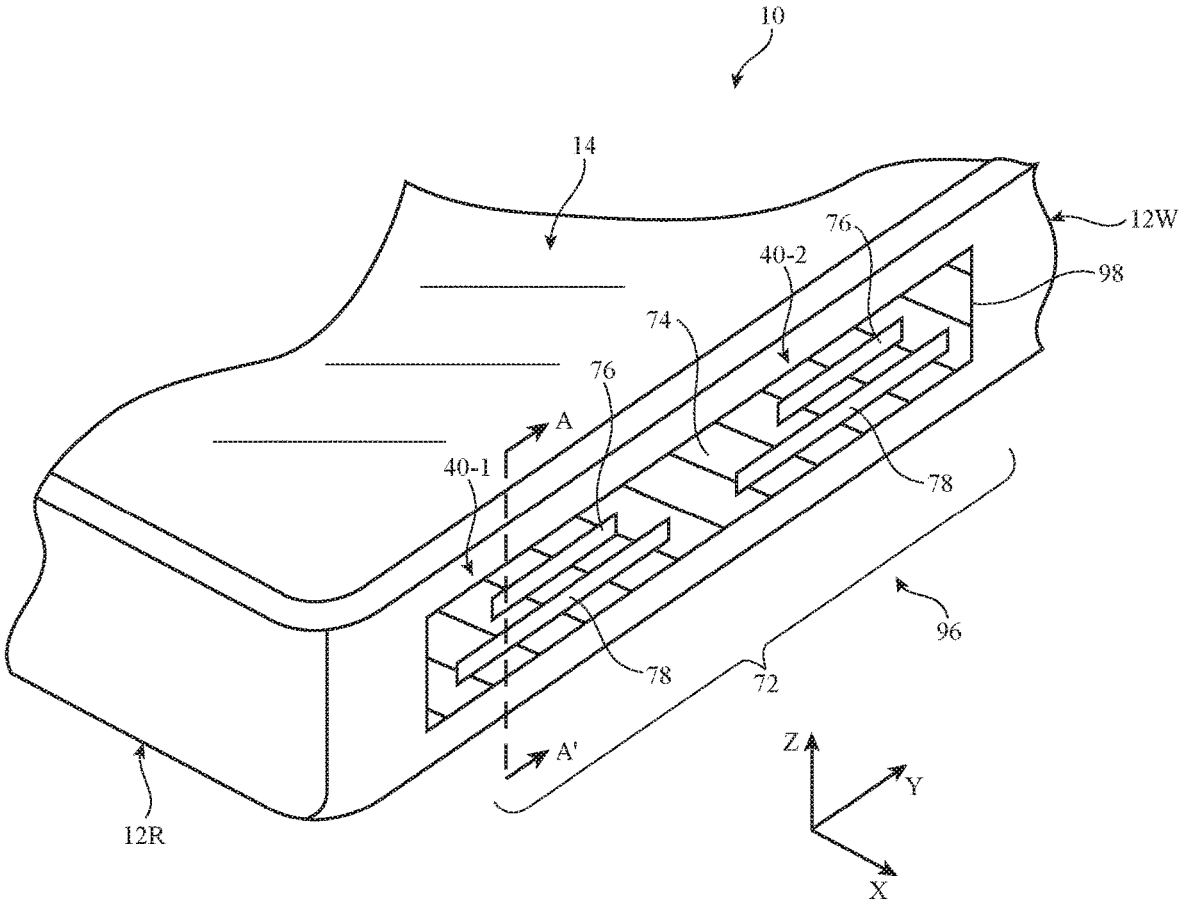
FIG. 10 is a perspective view of an illustrative electronic device having a doublet of multi-band antennas aligned with an opening in a housing sidewall in accordance with some embodiments.

FIG. 10 is a perspective view showing how one doublet of antennas may be mounted within a corresponding region 96 of device 10 (e.g., the bottom-right region 96 of FIG. 9). As shown in FIG. 10, peripheral conductive housing structures 12W may include a dielectric antenna window 98 that overlaps a given doublet 72 (e.g., antennas 40-1 and 40-2 of doublet 72 may be aligned with dielectric antenna window 98). Dielectric antenna window 98 may be filled with dielectric material such as plastic, ceramic, glass, or other dielectrics that serve to protect antennas 40-1 and 40-2 from damage and to hide antennas 40-1 and 40-2 from view.

Antennas 40-1 and 40-2 in doublet 72 may each include a corresponding slot 76 (e.g., for covering the 6.5 GHz UWB band) and a corresponding slot 78 (e.g., for covering the 8.0 GHz UWB band) in conductive structure 74. The antenna feeds across slot 76 in antennas 40-1 and 40-2 are omitted from the example of FIG. 10 for the sake of clarity. Slot 78 in antennas 40-1 and 40-2 may receive radio-frequency signals in the 6.5 GHz communications band through dielectric antenna window 98. Slot 76 in antennas 40-1 and 40-2 may receive radio-frequency signals in the 8.0 GHz communications band through dielectric antenna window 98. The received radio-frequency signals may be processed (e.g., by control circuitry 28 of FIG. 2) to identify an angle of arrival of the received radio-frequency signals (e.g., within the X-Y plane of FIG. 10). Antennas 40-1 and 40-2 may exhibit relatively uniform radiation patterns despite the presence of display 14 and rear housing wall 12R. This may, for example, allow doublet 72 to receive radio-frequency signals for identifying angle of arrival even in scenarios where device 10 is placed face-down or face-up on an external object such as a table top.

Figure 11:
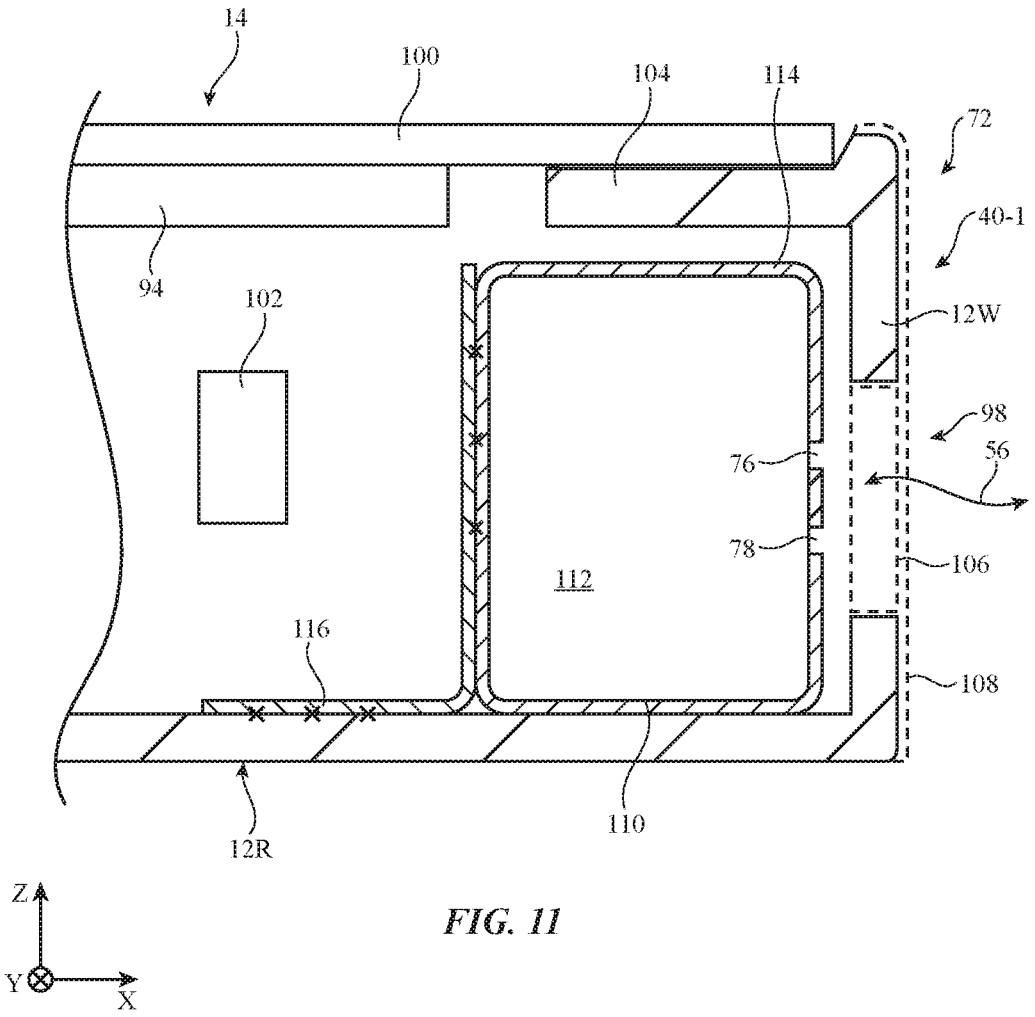
FIG. 11 is a cross-sectional side view of an illustrative electronic device having a doublet of multi-band antennas that is backed by a conductive antenna cavity in accordance with some embodiments.

FIG. 11 is a cross-sectional side view of doublet 72 within device 10 (e.g., as taken along line AA' of FIG. 10). Only antenna 40-1 of doublet 72 is shown in the cross-sectional side view of FIG. 11. However, similar structures may also be used in forming antenna 40-2 of doublet 72.

As shown in FIG. 11, peripheral conductive housing structures 12W may extend from rear housing wall 12R (e.g., a conductive rear housing wall) to display 14. Display 14 may include display module 94 and a display cover layer such as display cover layer 100 overlapping display module 94. Display cover layer 100 may be formed from glass, sapphire, or other dielectric materials. Display cover layer 100 may be mounted to ledge (datum) 104 of peripheral conductive housing structures 12W. If desired, peripheral conductive housing structures 12W may include a raised lip that extends around the peripheral edges of display cover layer 100. A layer of adhesive, brackets, or other interconnect structures (not shown) may be used to help secure display cover layer 100 to peripheral conductive housing structures 12W.

As shown in FIG. 11, doublet 72 may include dielectric substrate 110 and conductive traces 114 on dielectric substrate 110 (sometimes referred to herein as antenna carrier 110). Conductive traces 114 may form conductive structure 74 of FIGS. 7 and 10. Dielectric substrate 110 may be formed from dielectric materials such as plastic (e.g., molded plastic). The plastic material that forms dielectric substrate 110 may be provided with metal particles or other filler material that sensitizes dielectric substrate 110 to exposure from laser light. Following exposure to laser light, portions of dielectric substrate 110 that have been exposed to laser light will promote coating with electroplated metal, whereas portions of dielectric substrate 110 that have not been exposed to laser light will not promote electroplating metal growth. With this approach, which may sometimes be referred to as laser direct structuring (LDS), metal structures such as conductive traces 114 may be deposited using electroplating. Conductive traces 114 may be patterned to form slots 76 and 78 for antenna 40-1. This example is merely illustrative. If desired, some or all of conductive traces 114 may be replaced with metal foil, sheet metal, metal traces on a flexible printed circuit, metal portions of electronic components within device 10, or other conductive structures (e.g., conductive structures used to form conductive structure 74 of FIGS. 7 and 10).

Conductive traces 114 may be formed on one or more (e.g., all) sides of dielectric substrate 110. Conductive traces 114 may be coupled to rear housing wall 12R and/or peripheral conductive housing structures 12W if desired (e.g., using solder, welds, conductive adhesive, etc.). If desired, a conductive interconnect structure such as conductive tape 116 may be used to couple conductive traces 114 to rear housing wall 12R. Conductive tape 116 may include conductive adhesive that adheres the conductive tape to conductive traces 114 and rear housing wall 12R. Solder and/or welds may also be used to couple conductive tape 116 to rear housing wall 12R and/or conductive traces 114. Rear housing wall 12R may be held at a ground potential. In this way, conductive tape 116 may serve to ground conductive traces 114 to rear housing wall 12R. Rear housing wall 12R, conductive tape 116, ledge 104, and/or conductive traces 114 may surround and enclose dielectric substrate 110 (e.g., on all sides of the substrate) to form an antenna cavity such as antenna cavity 112 that backs slots 76 and 78. Rear housing wall 12R, conductive tape 116, ledge 104, and/or conductive traces 114 may serve to shield antenna 40-1 from electromagnetic interference with other components 102 within the interior of device 10.

As shown in FIG. 11, dielectric antenna window 98 may be formed in peripheral conductive housing structures 12W and may overlap slots 76 and 78. Dielectric antenna window 98 may be filled with dielectric material 106. A dielectric coating 108 may also cover dielectric antenna window 98. Dielectric material 106 may be omitted, if desired, in scenarios where dielectric coating 108 covers dielectric antenna window 98. Dielectric material 106 and dielectric coating 108 may include plastic, ceramic, glass, and/or any other desired material that is transparent to radio-frequency signals. If desired, dielectric material 106 and/or dielectric coating 108 may be provided with pigment or ink that configure dielectric material 106 and/or dielectric coating 108 to be optically opaque (e.g., to hide the interior of device 10 from view). Additional masking layers such as one or more ink layers may also be provided to hide the antennas within device 10 from view.

Slots 76 and 78 may transmit and receive radio-frequency signals 56 through dielectric antenna window 98. Antenna cavity 112 may serve to boost the antenna efficiency and gain for antenna 40-1 through dielectric antenna window 98. Antenna cavity 112 may also serve to optimize uniformity of the radiation pattern of antenna 40-1. The example of FIG. 11 is merely illustrative. In general, dielectric substrate 110 may have other shapes (e.g., shapes that accommodate the presence of other components within device 10). Similar structures may be used to form antenna 40-2 of doublet 72 (as shown in FIGS. 6 and 10). Both antennas 40-1 and 40-2 in doublet 72 may share the same dielectric substrate 110, antenna cavity 112, conductive tape 116, and conductive traces 114.

The foregoing is merely illustrative and various modifications can be made by those skilled in the art without departing from the scope and spirit of the described embodiments. The foregoing embodiments may be implemented individually or in any combination.

What is claimed is:

1. An electronic device comprising:

a conductive structure;

a first slot element in the conductive structure and configured to radiate in a first ultra-wideband communications band, wherein the first slot element has first and second opposing sides;

a second slot element in the conductive structure and configured to radiate in a second ultra-wideband communications band; and an antenna feed having a first feed terminal coupled to the conductive structure on the first side of the first slot element and a second feed terminal coupled to the conductive structure on the second side of the first slot element, wherein the first slot element is configured to indirectly feed the second slot element.

2. The electronic device defined in claim 1, wherein the second ultra-wideband communications band comprises lower frequencies than the first ultra-wideband communications band.

3. The electronic device defined in claim 2, wherein the first ultra-wideband communications band comprises an 8.0 GHz ultra-wideband communications band and the second ultra-wideband communications band comprises a 6.5 GHz ultra-wideband communications band.

4. The electronic device defined in claim 1, further comprising a dielectric substrate, wherein the conductive structure comprises conductive traces on the dielectric substrate.

5. The electronic device defined in claim 4, further comprising:

a third slot element in the conductive structure and configured to radiate in the first ultra-wideband communications band;

a fourth slot element in the conductive structure and configured to radiate in the second ultra-wideband communications band; and an additional antenna feed coupled across the third slot element, wherein the third slot element is configured to indirectly feed the fourth slot element.

6. The electronic device defined in claim 5, further comprising:

a conductive housing; and a dielectric antenna window in the conductive housing, wherein the first, second, third, and fourth slot elements are aligned with the dielectric antenna window.

7. The electronic device defined in claim 6, further comprising:

conductive tape configured to ground the conductive traces to the conductive housing, wherein the conductive tape and the conductive traces form an antenna cavity for the first, second, third, and fourth slot elements.

8. The electronic device defined in claim 7, wherein the conductive housing comprises peripheral conductive housing structures that run around a periphery of the electronic device, the dielectric antenna window is formed in the peripheral conductive housing structures, and the electronic device further comprises a display having a display cover layer mounted to the peripheral conductive housing structures.

9. The electronic device defined in claim 5, wherein the first, second, third, and fourth slot elements form a doublet of antennas configured to receive radio-frequency signals in the first and second ultra-wideband communications bands, the electronic device further comprising:

control circuitry configured to identify an angle of arrival of the radio-frequency signals received by the doublet of antennas.

10. The electronic device defined in claim 9, further comprising:

an additional doublet of antennas configured to receive the radio-frequency signals in the first and second ultra-wideband communications bands, wherein the additional doublet of antennas is oriented orthogonally with respect to the doublet of antennas.

11. The electronic device defined in claim 1, further comprising a capacitor coupled across the second slot element.

12. An electronic device having a periphery, the electronic device comprising:

a housing having peripheral conductive housing structures that run around the periphery;

a dielectric antenna window in the peripheral conductive housing structures and at one side of the periphery; and an antenna mounted within the housing and aligned with the dielectric antenna window, wherein the antenna is configured to receive radio-frequency signals in a first ultra-wideband communications band and a second ultra-wideband communications band at lower frequencies than the first ultra-wideband communications band through the dielectric antenna window at the one side of the periphery.

13. The electronic device defined in claim 12, wherein the antenna comprises a slot antenna having a first slot element configured to radiate in the first ultra-wideband communications band and a second slot element configured to radiate in the second ultra-wideband communications band.

14. The electronic device defined in claim 13, wherein the first slot element is directly fed by an antenna feed coupled across the first slot element, the first slot element being configured to parasitically excite the second slot element to radiate in the second ultra-wideband communications band.

15. The electronic device defined in claim 13, further comprising:

a dielectric substrate;

conductive traces on the dielectric substrate; and conductive tape that couples the conductive traces to the conductive housing, the conductive traces being patterned to form the first and second slot elements.

16. The electronic device defined in claim 15, wherein the slot antenna comprises a cavity-backed slot antenna having an antenna cavity formed from the conductive tape and the conductive traces.

17. The electronic device defined in claim 12, wherein the dielectric antenna window comprises dielectric material disposed in an opening in the peripheral conductive housing structures and a dielectric coating that covers the dielectric material and at least part of the peripheral conductive housing structures.

18. The electronic device defined in claim 12, wherein the radio-frequency signals in the first and second ultra-wideband communications bands are transmitted by external wireless equipment, the electronic device further comprising:

an additional antenna mounted within the housing and aligned with the dielectric antenna window, wherein the additional antenna is configured to receive the radio-frequency signals in the first and second ultra-wideband communications bands; and control circuitry configured to process the radio-frequency signals received by the antenna and the additional antenna to identify a location of the external wireless equipment.

19. A doublet of antennas configured to receive ultra-wideband signals in first and second frequency bands, comprising:

a conductive structure;

first and second slots in the conductive structure, wherein the first and second slots are directly fed by respective first and second antenna feeds and are configured to radiate in the first frequency band; and third and fourth slots in the conductive structure, the first slot being configured to parasitically excite the third slot to radiate in the second frequency band, and the second slot being configured to parasitically excite the fourth slot to radiate in the second frequency band.

20. The doublet of antennas defined in claim 19, wherein the first slot has a longitudinal axis extending parallel to a longitudinal axis of the third slot, the second slot has a longitudinal axis extending parallel to a longitudinal axis of the fourth slot, the first frequency band comprises 8.0 GHz, and the second frequency band comprises 6.5 GHz.

* * * * *